US005109751A

United States Patent [19]

Hagen et al.

[11] Patent Number: 5,109,751

[45] Date of Patent: May 5, 1992

[54] PARALLEL PATH SINGLE BAY AMMUNITION FEED SYSTEM

[75] Inventors: Richard L. Hagen, Villa Park; William W. Thompson, Fountain Valley, both of Calif.

[73] Assignee: North American Dynamics, Tustin, Calif.

[21] Appl. No.: 534,678

[22] Filed: Jun. 6, 1990

[51] Int. Cl.[5] ..... F41H 9/02

[52] U.S. Cl. ..... 89/33.16; 89/33.17; 89/34

[58] Field of Search ..... 89/34, 33.16, 33.17

[56] References Cited

U.S. PATENT DOCUMENTS

| | | | |
|---|---|---|---|
| 3,720,301 | 3/1973 | Garland et al. | 89/33.16 |
| 3,747,469 | 7/1973 | Ashley et al. | 89/34 |
| 4,412,611 | 11/1983 | Golden | 89/34 |
| 4,424,735 | 1/1984 | Bacon et al. | 89/34 |
| 4,434,701 | 3/1984 | Voillot | 89/34 |
| 4,494,440 | 1/1985 | Koine | 89/33.16 |
| 4,708,049 | 11/1987 | Durant et al. | 89/33.17 |
| 4,876,940 | 10/1989 | Aloi et al. | 89/33.16 |
| 4,881,447 | 11/1989 | Yanusko et al. | 89/34 |
| 4,882,972 | 11/1989 | Raymond | 89/34 |

*Primary Examiner*—David H. Brown
*Attorney, Agent, or Firm*—Price, Gess & Ubell

[57] ABSTRACT

An ammunition feed system wherein a single layer of ammunition is conveyed in a magazine by two independent closed loop conveyors disposed side by side in parallel, serpentine paths. Live rounds are fed on parallel output paths into first and second expansion rotor systems which, in turn, supply the rounds to a pair of feed rotors which insert the rounds alternately into a gun feeding conveyor. Spent rounds are withdrawn from the conveyor by a pair of return rotors, which, in turn, supply third and fourth expansion rotors, which return the spend rounds to the first and second parallel serpentine paths. The feed and return rotors contain pockets for receiving rounds alternating with surfaces for guiding rounds and cooperate with the expansion rotors to double the rate at which ammunition exits the system over that at which it is transferred out of the magazine. Rounds are further positively guided by rotor guide surfaces and auxiliary guiding surfaces during handling by the rotor systems between the magazine and gun feeding conveyor.

10 Claims, 3 Drawing Sheets

23a
133
134

141
23a
21
134
139

151
95
4
180
21
23
133
97
4

151
23a
23
136
131

23a 95
23
97

23a
23
136

137
95
21
97
139

121
137
95
21
23
131
133
97
139

PARALLEL PATH SINGLE BAY AMMUNITION FEED SYSTEM

BACKGROUND OF THE INVENTION

1. Field of the Invention

The subject invention relates to ammunition feed systems and, more particularly, to a feed system and associated magazine providing continuous positive round control at firing rates of on the order of 6,000 rounds per minute, wherein the effective feed rate is doubled over the transfer rate of the magazine. Hereinafter, rounds of ammunition may be referred to interchangeably as rounds, cartridges, bullets, or ammunition.

2. Description of Related Art

The existing armament system of a typical fighter aircraft feeds a gun operating at 6,000 rounds per minute, which translates to 100 rounds per second. The arrangement uses a drum-like feed unit disposed under the gun, which employs a helical feed and pickoff of rounds to achieve the required high feed rate. The ammunition is radially disposed about a helical member within the drum container, and when the unit is operated, the helix acts as a jackscrew, forcing ammunition from the drum at the desired rate. The drum-like unit takes up an exact cylindrical space, affording no flexibility of the installation envelope. In many cases a cylinder does not offer optimum packaging density, and it has appeared that additional space for avionics could be gained by employing a linear linkless ammunition feed system.

Linear linkless systems offer a very high packaging density which results from transporting rounds in a flexible ladder-type conveyor routed in serpentine fashion through adjacent linear paths in the magazine structure. While linear linkless systems are very space efficient, the operational rate of a conventional system matches the 100-round-per-second feed rate, resulting in tremendous wear and tear on the system and a large horsepower drive requirement.

Prior art is known which offers a partial solution to the high operating rate of a linear linkless system by placing rounds in two joined rows, nose to base, and moving transversely to the round axis. This double row conveyor arrangement is commonly referred to as a two-bay linear linkless magazine, and it operates at one-half of the gun rate. The drawback to this arrangement is that the two-bay width must be some percentage longer than two cartridge lengths and therefore is not applicable to installations requiring a narrow profile.

SUMMARY OF THE INVENTION

Accordingly, it is an object of the invention to improve ammunition feed systems;

It is another object of the invention to provide an ammunition feed system which conserves space and power;

It is another object of the invention to provide an ammunition feed system wherein the feed rate is much higher than the system operating rate;

It is still another object of the invention to provide an ammunition feed system where the effective feed rate to the gun is on the order of 6,000 rounds per minute and is twice the operating rate of the magazine; and It is another object of the invention to provide such a system which can withstand high "g" forces and other stresses of a tactical environment.

These and other objects and advantages are achieved by providing a single bay magazine having only one layer of conveyed ammunition in the axial direction of the cartridge and having a dimension only slightly more than the cartridge length in this direction. The magazine feeds rounds along two independent closed loop conveyors disposed side by side in parallel serpentine paths synchronized by associated gearing into a round path integrator. The round path integrator combines the rounds from the two paths into a single stream, effectively doubling the feed rate. The resultant system requires only one-fourth the power to operate as compared to a linear linkless system operating at full gun rate.

BRIEF DESCRIPTION OF THE DRAWINGS

The just-summarized invention, both as to its organization and manner of operation, together with further objects and advantages, may best be understood by reference to the following detailed description of the preferred embodiment, taken in connection with the accompanying drawings, of which.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a particularly efficient ammunition feed system.

Figure 1:
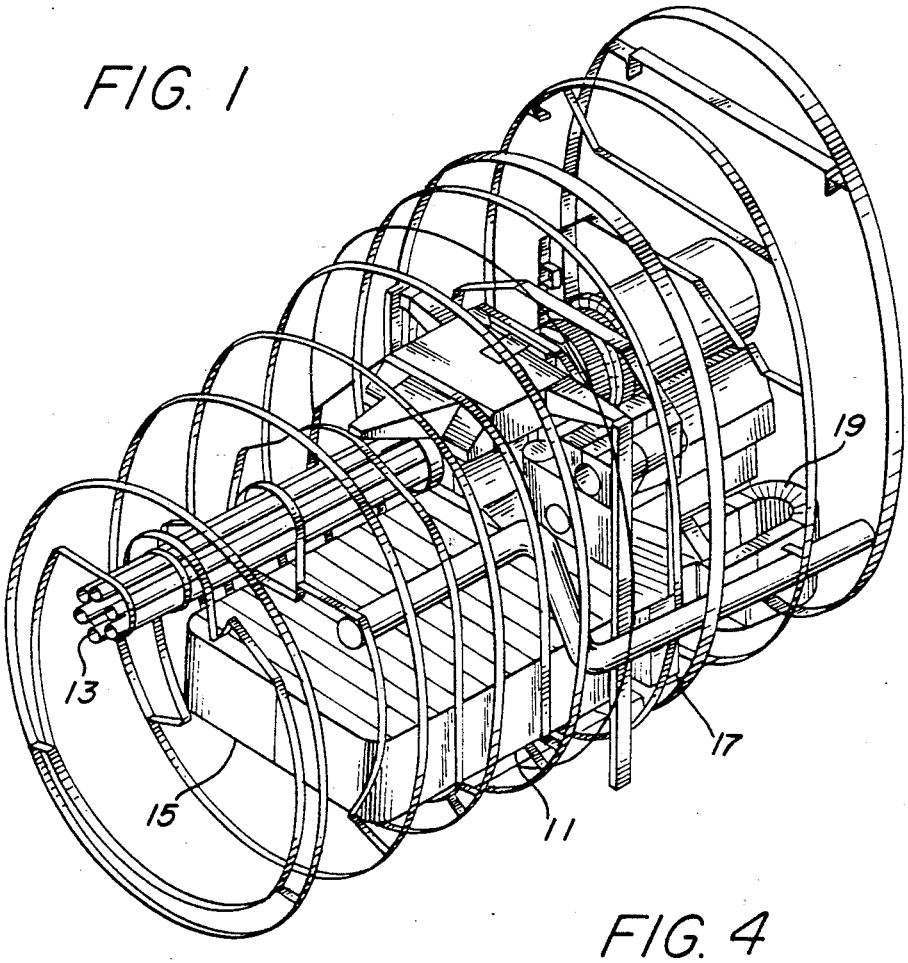
FIG. 1 is a side perspective illustrating an ammunition feed system according to the preferred embodiment in operational position.

FIG. 1 illustrates the preferred ammunition feed system 11 disposed in an aircraft nose section beneath the barrel of a gun 13. The feed system 11 includes a single bay magazine section 15 and a round path integrator section 17. Conventional flex chuting 19 exits the round path integrator 17 to feed ammunition to the gun 13.

Figure 2:
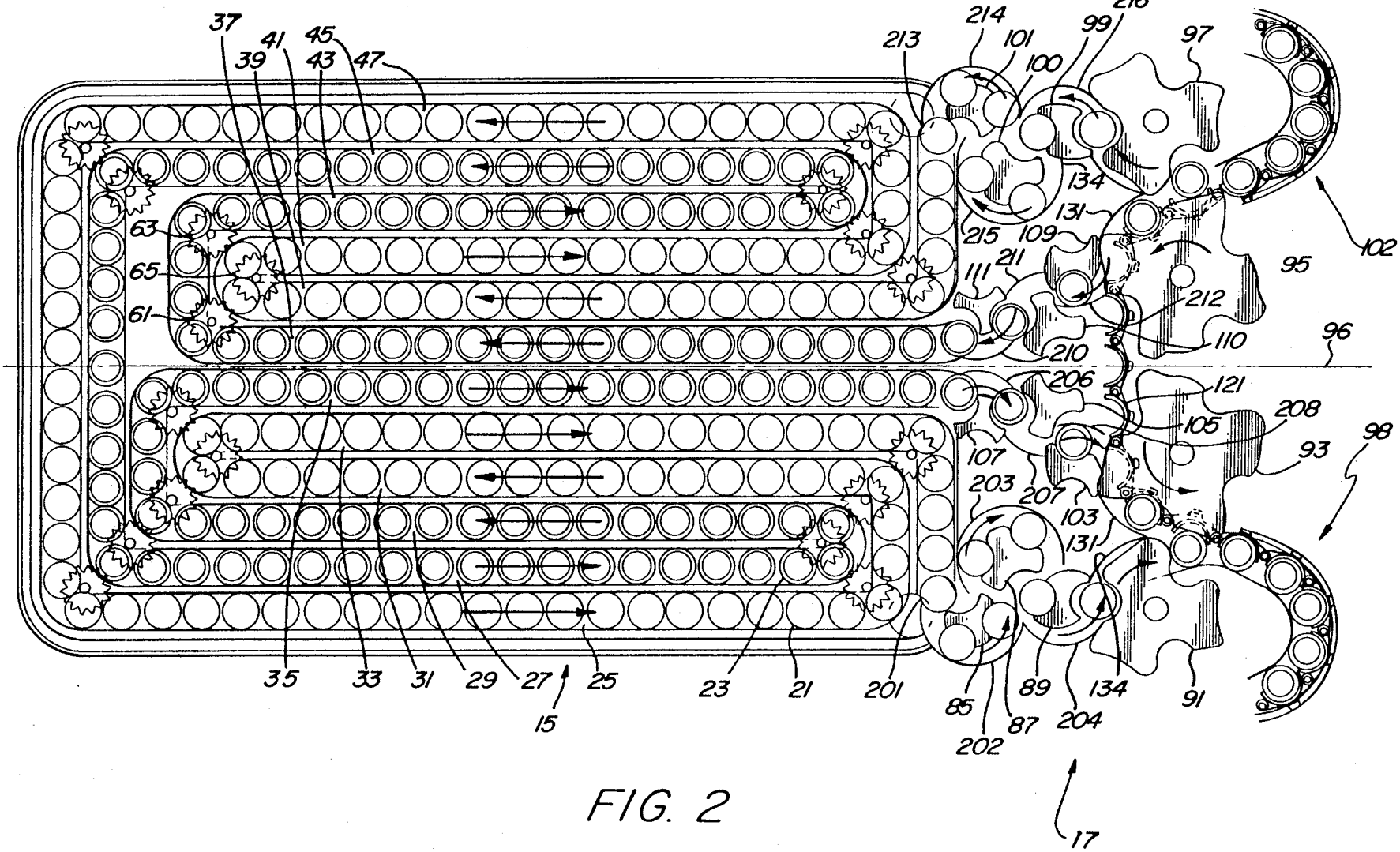
FIG. 2 is a top schematic view of the preferred embodiment with cover removed.

FIG. 2 illustrates the magazine 15 and round path integrator 17 in more detail. As may be seen, the magazine is fully loaded with a single layer of rounds 21 and 23 of ammunition. The rounds 21, 23 are disposed vertically (perpendicular to the plane of the paper) in a number of parallel, linkless, linear paths 25, 27, 29, 31, 33, 35, 37, 39, 41, 43, 45, 47 with common orientation, i.e., all rounds are nose down or, alternatively, nose up. The rounds 21 are separated into two groups. Rounds 21 of the first group are shown as single circles, while rounds 23 of the second group are shown as concentric circles. The direction of movement of the rounds 21, 23 is shown generally by the arrows on FIG. 2.

The unfired first rounds 21 travel up path 25, down path 31, and up path 33, where they are transferred from the serpentine conveyor into rotor 85 of the integrator 17. The spent rounds 21 enter path 39 of the serpentine conveyor, travel down that path 39, up path 41, and down path 47.

The second rounds 23 travel up path 27, down path 29, and up path 35, where they are transferred from the serpentine conveyor into rotor 107 of the integrator 17. After the second rounds 23 are fired, the spent rounds 23 enter into path 37, travel down that path 37, then up path 43, then down path 45.

The magazine's serpentine conveyor system transports the rounds along the parallel paths in the directions shown, and preferably employs a conventional chain ladder drive system. Other than sprockets, e.g., 61, 63, 65, the ladder conveyor system is not illustrated in detail in FIG. 2 for clarity. Suitable spring tension apparatus may be used to permit sprockets 61, 63, 65 to move linearly forward and backward to take up slack in the ladder system which may occur on start-up. Such tension apparatus may comprise, for example, a spring biased plate mounting the sprockets and linearly slidable in a slot parallel to the arrows shown in FIG. 2. A wire rope ladder drive system may also prove applicable such as that disclosed in U.S. Pat. application Ser. No. 405,338, now U.S. Pat. No. 4,941,393, incorporated by reference herein.

The path integrator 17 includes a pair of feed round control rotors 91 and 93, a pair of return round control rotors 95 and 97, and four sets of expansion rotors 85, 87, 89; 103, 105, 107; 109, 110, 111; and 99, 100, 101. The path integrator is divided into a feed section 98 to the right of center line 96 and return section 102 to the left of the center line 96. The feed section 98 transfers unfired rounds into a conventional conveyor assembly 121, while the return section 102 receives spent cases from the conveyor assembly 121 and transfers them back into the magazine 15. It will be observed that the structure of the return section 102 is symmetrical about center line 96 with that of feed section 98. Thus, rotors 93 and 91 are identical in shape to respective rotors 95, 97. In addition, the expansion rotors 101, 110, 107, and 85 are identical in shape, the expansion rotors 100, 111, 105, 87 are identical in shape, and the expansion rotors 89, 103, 109, 99 are identical in shape. The symmetrical rotor structures of sections 98, 102 are rotated such that one section 102 returns spent cases and the other section 98 feeds live rounds, as will be further appreciated from the ensuing discussion.

With respect to the first expansion rotors 85, 87, 89, rotors 85 and 87 are three-pocket rotors, while rotor 89 is a two-pocket rotor. The three pockets lie symmetrically about 120-degree center lines, while the two pockets are disposed symmetrically about 180-degree center lines. These rotors 85, 87, 89 are expansion rotors in the sense that they spread the received first rounds 21 apart the distance required to permit one of the second rounds 23 to be inserted between alternately received first rounds 21 in the conveyor 121, as further described. The geometry of the expansion rotors 85, 87, 89 may be selected to result, for example, in spreading the centers of rounds 21 from a distance of 1.3 inches in the magazine to 3.2 inches apart in the conveyor assembly 121. An identical spreading of rounds is achieved by the second set of expansion rotors 103, 105, 107. This then allows the second path to be integrated into the first, resulting in a final pitch between rounds of 1.6 inches, and thereby doubling the feed rate (rounds per minute). Correspondingly, the change in pitch (distance) between rounds effects an increase in linear velocity from 65 inches per second in the magazine 15 to 160 inches per second in the conveyor assembly 121.

The rounds 21 are guided into the first expansion rotor 85 by a guide 201, are retained therein by a guide 202, and are handed off to the second expansion rotor 87. A guide 203 retains the round in the second expansion rotor 87 until it is passed to the third expansion rotor 89. Guide 204 retains the rounds in rotor 89 until they are picked up by the first round control rotor 91.

The second set of expansion rotors 103, 105, 107 similarly cooperate with guides 206, 207, and 208 to load rounds 23 into the conveyor assembly 121. Every other conveyor element is filled with a round 23, such that rotor 91 may insert a round 21 between each round 23. In this manner, the rate in which rounds 21, 23 exit the integrator 17 in conveyor assembly 121 is doubled over the rate at which rounds 21, 23 are loaded into the path integrator 17 from the magazine 15.

The third and fourth set of rotors 99, 100, 101, 109, 110, and 111 are provided with similar associated guides 210 through 216. The third set of rotors removes rounds 21 from the second return round control rotor 97 and inserts them into path 39 of the serpentine conveyor system of magazine 15. The fourth set of rotors removes the remaining alternately spaced rounds 23 from the return round control rotor 95 and guides and inserts them into path 37 of the serpentine conveyor assembly magazine 15. Thus, the third and fourth set of rotors take rounds moving at a first rate on the conveyor assembly 121 and transfer them into the magazine at a second rate, which is one-half the first rate.

In the foregoing loading and unloading operations, the first and second round control rotors function to control the rounds so that the rounds are always subject to a guide surface contact throughout the mechanism, thus providing high reliability of operation. The manner in which the respective pairs of feed and return round control rotors 91, 93 and 95, 97 operate will be described in more detail in connection with FIG. 3, which particularly deals with operation of the rotors 95, 97 in receiving returned rounds or spent cases.

Figures 3A, 3B, 3C, 3D, 3E, 3F, 3G, 3H, 3I:
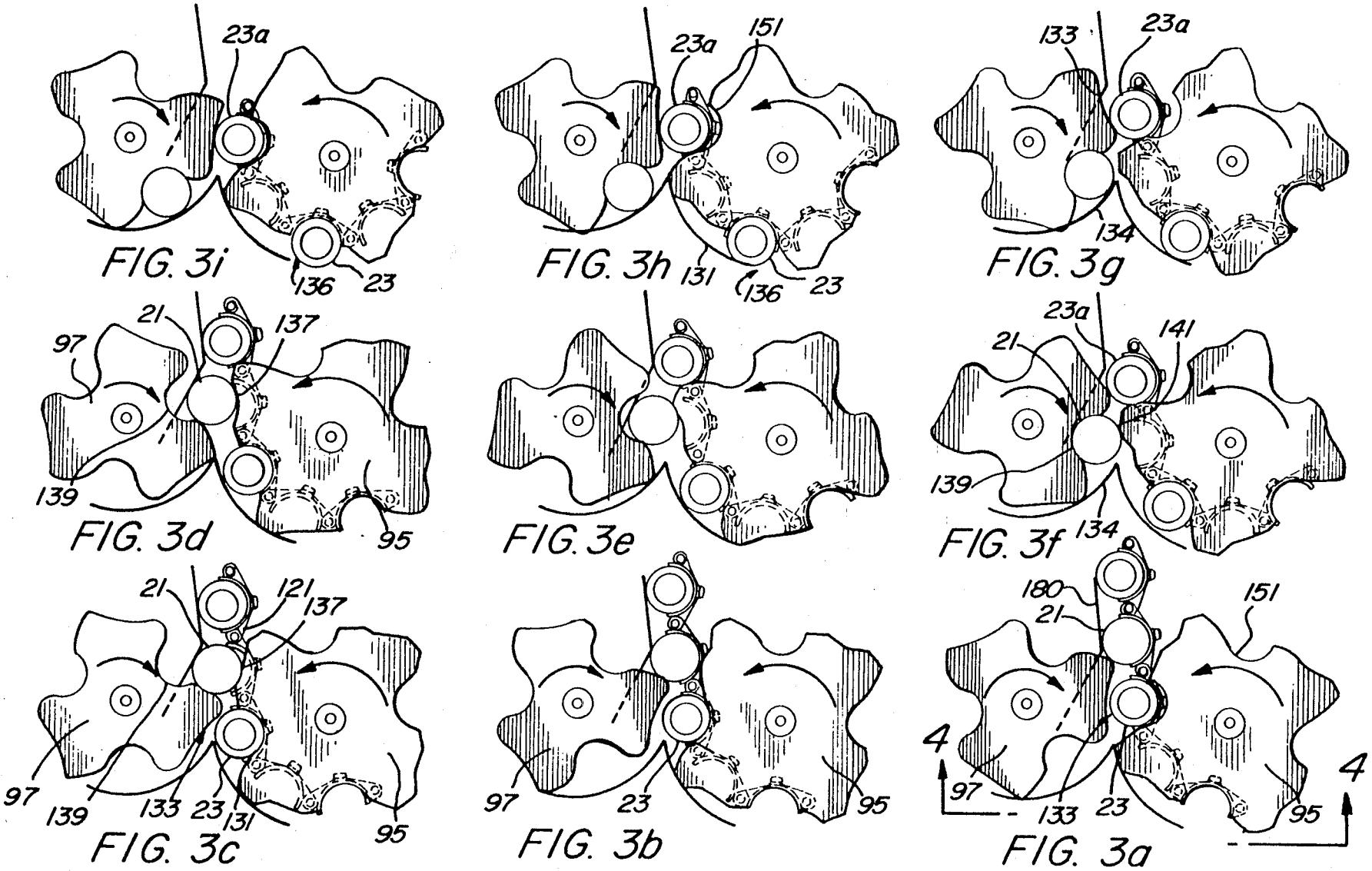
FIGS. 3*a* through 3*i* are sequential schematic diagrams illustrative of the integration of two separate round paths in the preferred embodiment.

In FIG. 3*a*, concave surface 133 of rotor 97, one of three identical, contoured, generally concave surfaces on rotor 97, is providing a guide surface for a round 23. The succeeding round 21 is constrained in its carriage element by fixed guide 180. In FIG. 3*b*, rotor 97 has rotated slightly further clockwise and is still guiding and controlling the round 23. Rotor 95 has rotated further, counterclockwise in synchronism with and at a rotational rate proportional to the ratio of the number of pockets in rotor 97 divided by the number of pockets in rotor 95.

At the point of rotation of rotors 95, 97 shown in FIG. 3*c*, rotor 95 has rotated to the point where the end of surface 133 is still slightly touching round 23 and round 23 is entering fixed guide 131. From this position, i.e., FIGS. 3*d* through 3*h*, round 23 is captured by fixed guide 131. In FIG. 3*i*, round 23 is transferred into rotor 109 (FIG. 2).

Further in FIG. 3*c*, round 21 is just beginning to leave its respective carriage element in the conveyor assembly 121. More particularly, round 21 is being forced and guided out of the carriage element by guide surface 137 of rotor 95. As shown, guide surface 137 is initially rounded, slopes upward at a first slope, then upward at a second steeper slope, and then is bluntly rounded tangentially. In practice, the contours of guide surface 137 and guide surface 133 are determined by kinematic layout, as known to those skilled in the art. In FIG. 3*c*, surface 137 is beginning to displace the round 21 into a pocket 139 in rotor 97, while being further constrained to its prescribed round path by fixed guide 180.

FIGS. 3*d* and 3*e* illustrate the further progression of round 21 out of the conveyor assembly and into the pocket 139 of rotor 97 under the guidance of rotor surface 137. In FIG. 3*f*, the "blunt" tangential portion 141 of surface 137 is exerting a guiding force directing the round 21 nearly completely into pocket 139 and an entryway provided by a fixed guide 134.

In FIG. 3*g*, round 21 is completely inserted in pocket 139 of rotor 97 and is being rotated around a guide 134. At the same time, concave surface 133 of rotor 97 (three identical, contoured, generally concave surfaces), which began contacting the next round 23*a* in FIG. 3*f*, is now positively guiding that next round 23*a*.

In FIG. 3*h*, round 23 is just about to exit through gap 136 into rotor 109 (see FIG. 2), while pocket 151 of rotor 95 is beginning to receive round 23*a* and its respective carriage element. Rounds 23 and 23*a* are afforded clearance by pockets 151 in rotor 95, which have a radius which matches that of the rounds 23, 23*a*, and which allow every other round to be transferred by rotor 95 and guide 131.

Finally, in FIG. 3*i*, round 23 has been handed off to rotor 109 through gap 136 and round 23*a* is in the position of round 23 shown in FIG. 1.

Figure 4:
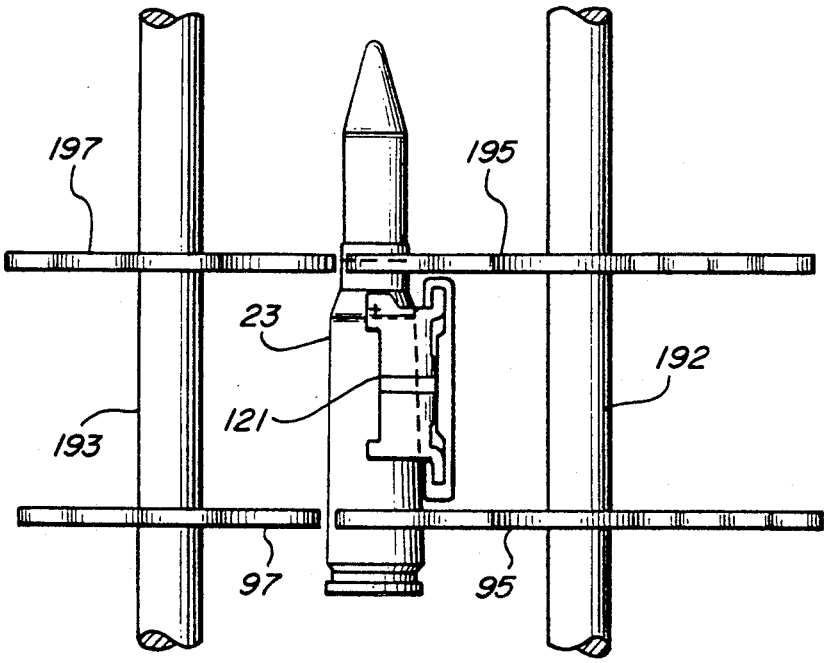
FIG. 4 is a side view of FIG. 3–1.

As may be appreciated, each rotor 85, 87, 89, 103, 105, 107, 109, 110, 111, 99, 100, 101, 91, 93, 95, 97 in the top views of FIGS. 2 and 3 is paired with a proportionately shaped and identically functioning rotor located beneath it on a conveyor shaft in order to properly support and transfer the rounds of ammunition 21, 23. FIG. 4 is illustrative, depicting a round 23, as well as the round control rotors 95, 97, also shown in FIGS. 2 and 3. Each round control rotor 95, 97 is paired with a cooperating round control rotor 195, 197 on respective shafts 192, 193. The rotors 195, 197 function identically to their cooperating rotors 95, 97, the only difference being a proportional enlargement to accommodate the smaller diameter of round 23 at its contact point with rotors 195, 197.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Ammunition feed apparatus comprising:

a magazine means for providing first and second series of rounds on first and second paths; and path integrator means for receiving the first and second series of rounds and for integrating said first and second series of rounds into a third series of rounds;

wherein said path integrator means comprises first and second rotor means located opposite one another for alternately integrating rounds received from two paths into said third series of rounds; and wherein each said rotor means includes a perimeter which contains a plurality of pockets for receiving rounds, each pair of pockets being separated by a surface contoured to guide alternate rounds being transported in the pocket of the opposite rotor means.

2. The ammunition feed system of claim 1 wherein said magazine means comprises a single layer of vertically disposed rounds.

3. The ammunition feed apparatus of claim 1 further comprising first and second expansion rotor means cooperating with said pair of rotor means for increasing the linear velocity of said rounds.

4. The ammunition feed apparatus of claim 3 wherein said first and second expansion rotor means each comprise a two-pocket rotor and first and second three pocket rotors disposed to transfer rounds to said two-pocket rotor.

5. Ammunition feed apparatus for feeding unfired rounds on first and second paths and returning spent rounds to seventh and eighth paths, comprising:

a conveyor means for serially receiving and conveying rounds in a plurality of serially disposed receptacles;

first expansion rotor means for receiving unfired rounds from said first and second paths, for increasing the velocity of said unfired rounds and for transferring said unfired rounds to third and fourth paths;

a first pair of rotor means cooperating with said receptacles and said first expansion rotor means for guiding unfired rounds travelling on said third and fourth paths alternately into the receptacles of said conveyor means;

second expansion rotor means for reducing the velocity between spent rounds on fifth and sixth paths and returning said spent rounds to said seventh and eighth paths; and a second pair of rotor means cooperating with said receptacles and said second expansion rotor means for withdrawing spent rounds from said conveyor means, for separating said spent rounds into first and second groups, and for causing a first group of said spent rounds to travel on said fifth path and said second group of spent rounds to travel on said sixth path.

6. The feed apparatus of claim 5 further including round guide means cooperating with each rotor means such that each round is continually in touch with a round guiding surface.

7. Ammunition storage and feed apparatus comprising:

a magazine means for providing first and second series of rounds on first and second continuous serpentine paths, wherein both paths are disposed in parallel to form a single layer of rounds; and path integrator means for receiving the first and second series of rounds from the single layer magazine means and for integrating said first and second series of rounds into a third series of rounds.

8. The ammunition feed system of claim 7 wherein said magazine means comprises:

a single layer of vertically disposed rounds; and first and second independent closed loop conveyors for conveying said rounds disposed side by side in parallel serpentine paths.

9. The ammunition feed apparatus of claim 7 wherein said path integrator means comprises a pair of rotor means for alternately integrating rounds received from two paths disposed within said single layer into said third series of rounds.

10. The ammunition feed apparatus of claim 9 wherein each of said pair of rotor means includes a perimeter which contains a plurality of pockets for receiving rounds, each pair of pockets being separated by a surface contoured to guide alternate rounds being transported in the pocket of the opposing rotor means, whereby said contoured surfaces function as dynamic rotary round guides.

* * * * *